United States Patent [19]

Satten et al.

[11] Patent Number: 4,966,481

[45] Date of Patent: Oct. 30, 1990

[54] CLEANING FLUID DISPENSER AND APPLICATOR

[76] Inventors: Robert Satten, 100 Wilmot Rd., Deerfield, Ill. 60015; Helmut Held, 1811 W. Summerdale, Chicago, Ill. 60640

[21] Appl. No.: 224,714

[22] Filed: Jul. 27, 1988

[51] Int. Cl.[5] ..... B67D 3/00; A47L 25/00

[52] U.S. Cl. ..... 401/205; 222/481.5; 401/279

[58] Field of Search ..... 401/140, 189, 191, 203, 401/204–207, 261, 263, 265, 266, 268, 270, 276, 278, 279, 289; 222/478, 481.5; 239/124, 373, 586; 251/322, 323; 137/212, 315, 588

[56] References Cited

U.S. PATENT DOCUMENTS

| | | | |
|---|---|---|---|
| 152,397 | 6/1874 | Messmer | 222/481.5 |
| 605,049 | 5/1898 | Nicholsburg . | |
| 1,343,951 | 6/1920 | Whyte . | |
| 1,904,041 | 4/1933 | Evans | 401/278 |
| 2,014,642 | 9/1935 | Andrews . | |
| 2,187,671 | 1/1940 | Suddarth | 401/140 X |
| 2,255,879 | 9/1941 | Garvey | 401/278 |
| 2,592,136 | 4/1952 | Garvey . | |
| 2,598,417 | 5/1952 | Niemann . | |
| 2,599,728 | 6/1952 | Seaberg . | |
| 2,663,040 | 12/1953 | Leckler . | |
| 2,735,590 | 2/1956 | Ayres . | |
| 2,742,660 | 4/1956 | Esley | 401/205 |
| 3,129,892 | 4/1964 | Tillman . | |
| 3,261,515 | 7/1966 | Luedtke | 401/205 X |
| 3,343,795 | 9/1967 | Pinke . | |
| 3,361,303 | 1/1968 | Jacuzzi . | |
| 3,373,907 | 3/1968 | Batrow . | |
| 3,395,835 | 8/1968 | Tarran . | |
| 3,410,492 | 11/1968 | Douglas et al. . | |
| 3,419,197 | 12/1968 | Battaglia . | |
| 3,588,040 | 7/1968 | Ward . | |
| 3,981,597 | 9/1976 | Cohn . | |
| 4,057,353 | 11/1977 | Kitatani | 401/204 X |
| 4,063,667 | 12/1977 | Flider . | |
| 4,078,865 | 3/1978 | Moser | 401/140 X |
| 4,139,585 | 2/1979 | Kirschner et al. . | |
| 4,225,254 | 9/1980 | Holberg et al. | 401/206 X |
| 4,269,333 | 5/1981 | Nakai et al. | 137/588 X |
| 4,278,188 | 7/1981 | Stephenson et al. . | |
| 4,350,299 | 9/1982 | Stephenson et al. . | |

OTHER PUBLICATIONS

Hawley's Condensed Chemical Dictionary, Eleventh Edition, Van Nostrand Reinhold Co., 1987, p. 541.

*Primary Examiner*—Richard J. Apley
*Assistant Examiner*—David F. Crosby
*Attorney, Agent, or Firm*—Dick and Harris

[57] ABSTRACT

A fluid dispenser apparatus for use in cleaning surfaces of electrical printing apparata, among other surfaces, is provided for exchangable attachment to a fluid container. The apparatus includes a removable tube for extended and directed delivery and placement of the fluid, on the surface being cleaned. An applicator plate, supporting a densely formed, replaceable sponge, is located at the end of the tube to collect and help keep the fluid in a liquid state to facilitate application and scrubbing therewith. A pushbutton valve permits selective, variable control of the flow rate of the fluid. A vent may be alternatively provided to improve back pressure in the fluid dispenser apparatus and improve its dispensing characteristics. The apparatus is configured for facilitated assembly and disassembly for facilitated cleaning of the pushbutton valve.

31 Claims, 2 Drawing Sheets

CLEANING FLUID DISPENSER AND APPLICATOR

BACKGROUND OF THE INVENTION

The present invention relates in general to fluid dispenser, apparatuses and in particular to a combined fluid dispenser and cleaner apparatus for use in combination with a container holding fluid, such as cleaning fluid or solvent, for the controlled, directed delivery of said fluid to a selected surface for scrubbing and cleaning of same. The present invention utilizes an operator actuatable valve means to regulate the rate of flow of the fluid through the fluid dispenser apparatus.

Fluid dispenser apparatuses exist in the prior art which combine a fluid flow control means and a fluid applicator means, and which are removably attachable to fluid containers. However, such prior art fluid dispenser apparatuses may be provided with fluid flow control means that are relatively complicated in configuration and may therefore be more difficult and/or costly to manufacture and assemble, as well as more difficult to clean after use. Furthermore, such prior art fluid dispenser apparatuses may include applicator means which are physically close to the fluid flow control means and to the fluid container, thus requiring that the user,s hands and face be close to the applicator means and exposed to the fluid and/or its fumes. In prior art fluid dispenser apparatuses, if the fluid used was volatile, caustic or otherwise noxious, the user might have had to employ protective gloves and/or a mask to safely use the fluid dispenser apparatus. This may be particularly true with regard to the use of volatile or caustic cleaning fluids which require some scrubbing effort simultaneously with the application of the fluid. It would be advantageous therefore to provide an applicator means which is physically removed from the fluid flow rate control means.

A common problem in fluid dispensing apparatuses that are used in association with removable fluid containers, is the tendency for the fluid flow to become sluggish as more and more fluid is removed from the container. This is principally due to the fact that fluid can only exit (or enter) the container via the dispenser apparatus once it is in place, and as the fluid (liquid, usually) exits the container, a lower-than-ambient pressure air pocket forms in the container. This sluggish flow 5 may then be alleviated by having a squeezable container, which then must "gulp" air after each surge of fluid flow. Alternatively, air may be introduced into the interior of the container as the fluid leaves, via a venting passage. However, including such venting passages can make the design of the dispenser apparatus more complicated and can affect the performance of the dispenser by increasing the likelihood of inadvertent spillage or evaporation of the fluid from the container.

It is accordingly an object of the present invention to provide a fluid dispenser apparatus which may be removably attached to a fluid-filled container and which includes, in cooperative combination, a user actuatable fluid flow control means and fluid applicator means for positioning and directing the fluid flow.

Another object of the present invention is to provide such a fluid dispenser apparatus which includes a relatively simple construction to facilitate the manufacture, assembly, and cleaning of the fluid flow control means.

A further object of the present invention is to provide a fluid dispenser apparatus which includes a fluid applicator means which enables the user to direct and position the fluid without the user's hands and face being immediately and directly exposed to the fluid or any possible fumes, as the fluid exits the applicator means.

A still further object of the present invention is to provide such a fluid dispenser apparatus including an applicator means configured for scrubbing a desired surface while the fluid is being applied.

It is also an object of the present invention to alternatively provide a fluid dispenser apparatus which is removably attachable to a fluid container and includes a venting means which facilitates the flow of fluid from the container and obviates the need for squeezing or otherwise deforming the container.

Yet another object of the present invention is to provide such a fluid dispenser apparatus having a venting means, which venting means is simply incorporated into the structure of said apparatus, but which tends to protect against inadvertent spillage or evaporation of the fluid.

Another object of the present invention is to provide such a fluid dispenser apparatus having a venting means which may be removed and/or disabled without otherwise affecting the structure and general function of the apparatus.

These and other objects of the invention will become apparent in light of the present specification, drawings and claims.

SUMMARY OF THE INVENTION

The present invention comprises a fluid dispenser apparatus, for use with a container having therewithin a fluid, for the facilitated release and delivery thereof from said container upon actuation of the fluid dispenser apparatus. The present invention is particularly suited for use with cleaning solutions such as volatile cleaning fluids, like freon.

The apparatus comprises fluid conduit means for directing and providing a passageway for conveying the fluid away from the container. The fluid conduit means has oppositely arranged first and second ends. Flow regulation means are operably associated with the first end of the fluid conduit means for the selective, operator-actuated control of flow of the fluid from the container through the fluid dispenser apparatus. Adapter means are operably associated with the flow regulation means for operable attachment of the fluid dispensing apparatus upon the container at a fluid release orifice thereof so as to define an interface between the fluid conduit means and the container. The adapter means includes sealing means for ensuring that the fluid is prevented from escaping through the interface between the fluid release orifice and the adapter means. Applicator means are operably arranged upon the second end of the fluid conduit means for collecting and retaining the fluid and permitting the operator to apply the fluid upon a desired surface.

The flow regulation means comprises valve means operably positioned between the first end of the fluid conduit means and the adapter means, for controlling the flow of the fluid through the fluid conduit means by selectively interrupting the fluid flow.

In the preferred embodiment of the invention, the valve means comprises a substantially cylindrical valve chamber housing which has a valve chamber disposed therein. The valve chamber has a substantially cylindrical inner surface and extends from an interior region of the valve chamber housing to an opening upon an outer surface region of the valve chamber housing. The valve chamber housing further has an entry passage position therein which extends from the adapter means to an entry opening in the valve chamber. The valve chamber housing also has an exit passage position therein which extends from an exit opening in the valve chamber. The entry and exit passages transport the volatile fluid from the adapter to the valve chamber, and from the valve chamber to the first end of the fluid conduit means, respectively. A substantially cylindrical plunger member is operably positioned within the valve chamber for limited longitudinal movement therein, between a first and second end positions, such that when the plunger member is in the first end position, the plunger member blocks the entry and exit passages to prevent flow of the fluid through the flow regulation means. When the plunger member is in the second end position, the plunger member is moved away from the entry and exit openings, enabling flow of the fluid through the flow regulation means. The valve means also comprises a biasing member which is operably positioned within the valve chamber for continuously prompting the plunger member toward the first end position. The flow through the fluid dispenser apparatus is thereby generally precluded, except when the pushbutton end of the plunger member is depressed.

Venting means may be operably associated with the adapter means and the valve means for facilitating flow of the fluid out of container and through the fluid dispensing apparatus by enabling entry of the ambient air into the container as the fluid flows out of the container.

In an alternative preferred embodiment of the invention, the valve chamber housing has first and second vent passages operably disposed therein. The first vent passage extends from the adapter means to a first vent opening in the valve chamber. The second vent passage extends from a second vent opening in the valve chamber to an outer vent opening upon an outer surface portion of the valve chamber body. A vent tube member is provided for directing flow of ambient air into the container. A first end of the vent tube member is inserted into and through the first and second vent openings, and through the fluid orifice and into the container. A uni-directional check valve member is operably disposed on the second end of the vent tube and prevents flow of any fluid at any time from the container through the vent tube toward the valve chamber. The uni-directional check valve member, however, does allow ambient air to flow into the container to prompt flow of the fluid out of the container by increasing the back pressure therein. An extension tube member may be selectively positioned between the vent tube member and the check valve member in order to accommodate variably sized containers, so as to maintain the check valve near to the bottom of the container.

In a preferred embodiment of the invention, the plunger member has contours formed upon its outer surface which cooperate with the inner surface of the valve chamber so as to completely block the entry and exit openings, and thereby prevent flow of the fluid, when the plunger member is in the first position. The contours of the plunger member gradually unblock the entry and exit openings as the pushbutton end of the plunger member is gradually depressed, so as to gradually increase the flow rate of the fluid, until the plunger member is in the second end position and the entry and exit openings are completely unblocked and a maximum rate of flow of the fluid is permitted.

In the preferred embodiment of the invention, the biasing means comprises a compressed helical spring. Also, the fluid conduit means comprises an elongated rigid hollow tubing member.

The adapter means comprises, in the preferred embodiment of the invention, a hollow cylindrical housing member which has a first end, operably associated with the flow regulation means for directing the flow of the fluid towards the fluid conduit means. The sealing means includes a second substantially open end of the hollow cylindrical housing member which has a screw threaded inner annular surface for threaded receipt by the adapter means, of the container holding the fluid.

The applicator means includes a substantially planar applicator plate which is affixed to the second end of the fluid conduit means. The applicator plate has an aperture disposed centrally thereof for enabling passage of the fluid out of the fluid conduit means. The applicator means also includes fluid retaining and scrubbing means which are operably arranged upon the applicator plate for collecting the fluid and retarding its evaporation, for application of the fluid upon a desired surface. In the preferred embodiment of the invention, the fluid retaining and scrubbing means comprises a densely packed porous material, such as foam rubber material. The applicator plate is arranged, preferably, at a substantially oblique angle relative to the fluid conduit means.

For convenience and increased useful life of the apparatus, the fluid retaining and scrubbing means is preferably mounted upon an applicator clip which can be removably affixed to the applicator plate. When the fluid retaining and scrubbing means becomes worn or soiled, it can then be readily replaced.

In the preferred embodiment of the invention, the flow regulating means and the adapter means are operably disposed within a substantially cylindrical housing. The apparatus is particularly suited for use in combination with a substantially liquid freon solvent compound, for cleaning such surfaces as corona wires, print heads and feed rollers, platens and keyboards for facsimile machines, printers, typewriters, copy machines and other printing apparata, among other surfaces.

DETAILED DESCRIPTION OF THE DRAWINGS

Figures 1, 2:
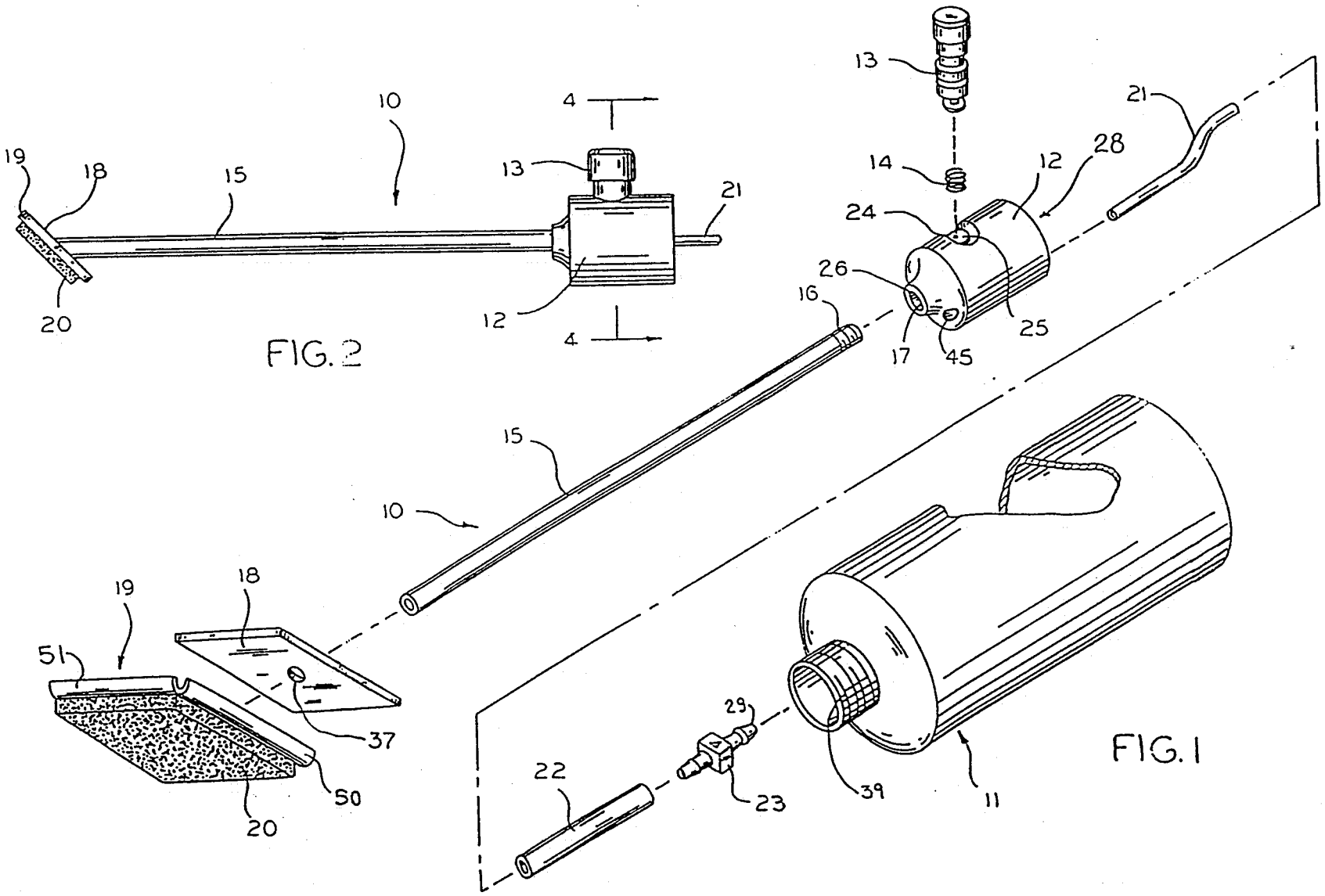
FIG. 1 of the drawings is an exploded top left perspective view of the fluid dispenser apparatus, also showing a typical container used in association therewith.
FIG. 2 of the drawings is a left side elevation of the fluid dispenser apparatus, shown without a container associated therewith.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Fluid dispenser apparatus 10 is seen in FIG. 1, in exploded perspective view. Along with fluid dispenser apparatus 10 is fluid container 11, to which apparatus 10 may be removably attachable by any suitable method, such as threads 39 around the orifice of container 11 being received by grooves 27 of apparatus 10 (see FIG. 5). The fluid in container 11 will ordinarilY comprise a cleaning fluid or solvent, such as liquid freon or the like. Fluid dispenser apparatus 10 comprises substantially cylindrical valve body 12 which serves both as a housing for valve chamber 25 (see FIG. 5) and as an adapter for connecting apparatus 10 to container 11. Valve body 12 is substantially hollow and includes front orifice 26, chamber opening 24, valve chamber 25 and back opening 28, (see also FIGS. 2, 5). Vent tube 21 is inserted into valve body 12 via back opening 28, and communicates with the ambient air via vent opening 45. Apparatus 10 also includes elongated tube 15, which is preferably attached to valve body 12 at front orifice 26 by threads 16, which are received by grooves 17 in valve body 12. At the opposite end of elongated tube 15, from front orifice 26, is affixed applicator plate 18. Applicator plate 18 has aperture 37 through which the fluid from container 11 can pass. Applicator clip 19 is removably affixable to applicator plate 18 by any suitable means, such as by sliding applicator clip 19 into place upon applicator plate 18. In one embodiment, applicator clip 19 includes guides 50, 51 which emanate from three sides of a substantially flat rectangular portion of applicator clip 19 (one guide is not shown in FIG. 1). Applicator clip 19 may be laterally slid upon and around applicator plate 18 via the remaining open side (not shown) of applicator clip 19. Guides 50, 51 have an inwardly curved or grooved cross-section, with respect to the central region of applicator clip 19, so as to tend to tightly hold applicator clip 19 in place upon applicator plate 18, once applicator clip 19 is slid into position thereon. Applicator clip 19 carries dense sponge strip 20, which is positioned relative to aperture 37 so as to absorb and retain, at least temporarily, any fluid which may come through aperture 37. Sponge 20 enables apparatus 10, in combination with cleaning fluid or solvent-filled container 11, to be used to scrub and clean such surfaces as corona wires, print heads and feed rollers, platens and keyboards for facsimile machines, printers, typewriters and other printing apparata, among other surfaces.

As can be seen in FIG. 2, in the preferred embodiment of the invention, applicator plate 18, applicator clip 19 and dense porous sponge 20 are intended to be affixed to tube 15, at a substantially oblique angle thereto.

Vent tube 21 is inserted into valve body 12 via rear opening 28, in a manner to be described hereinafter. One-way check valve 23 may be affixed to vent tube 21, in combination with extension tube 22 or not, as necessary to bring check valve nozzle 29 into the vicinity of the bottom of container 11 when apparatus 10 and container 11 are assembled. One-way check valve 23 is oriented, as indicated by the delta, to permit flow only in the direction away from valve body 12. The forward end of vent tube 21, accordingly, is positioned within valve body 12 so as to have access to outside air. Tube 15 and rear opening 28 are in fluid communication with each other, via valve chamber 25, as is later described in reference to FIGS. 3, 4, and 5, and the flow of the fluid from container 11 through valve body 12 is to be regulated by plunger 13 and spring 14, once assembled within valve chamber 25. During use in combination with container 11, fluid dispenser apparatus 10 may be required to be inverted, such that applicator plate 18 is pointed downwardly with respect of container 11, the fluid therein being drawn through apparatus 10 by gravity. Vent tube 21, (optional) extension tube 22 and one-way check valve 23 facilitate flow of fluid through apparatus 10 by providing ambient air pressure ("back pressure") within container 11 so as to eliminate the need for the apparatus to "gulp" air to facilitate fluid flow. However, should a slower flow rate be desired, or a less viscous fluid be employed, then apparatus 10 may be utilized without vent tube 21, extension tube 22 or one-way check valve 23.

Figure 3:
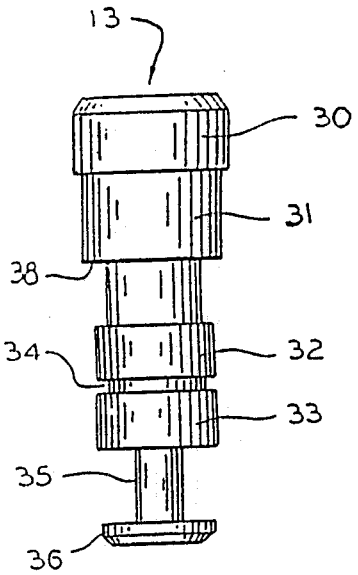
FIG. 3 of the drawings is a side elevation of the plunger according to the invention.

Plunger 13 is shown in closer detail in FIG. 3, and comprises a substantially cylindrical member. In the preferred embodiment of the invention, plunger 13 is fabricated of nylon, or other suitably smooth, rigid material. Plunger 13 is configured to comprise several distinctly shaped regions, including pushbutton portion 30, main stem portion 31, upper rim 32, lower rim 33, fluid groove portion 34, tappet stem 35, and tappet 36.

Figure 4:
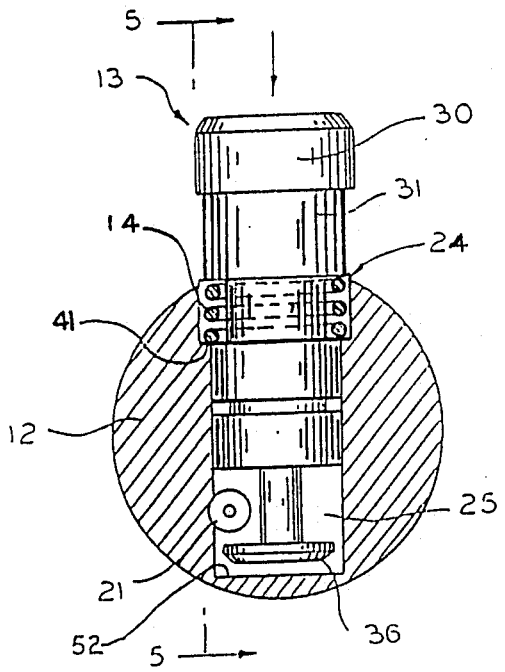
FIG. 4 of the drawings is a front elevation, partly in section and taken along line 4—4 of FIG. 1, of the valve chamber and plunger.
Figure 5:
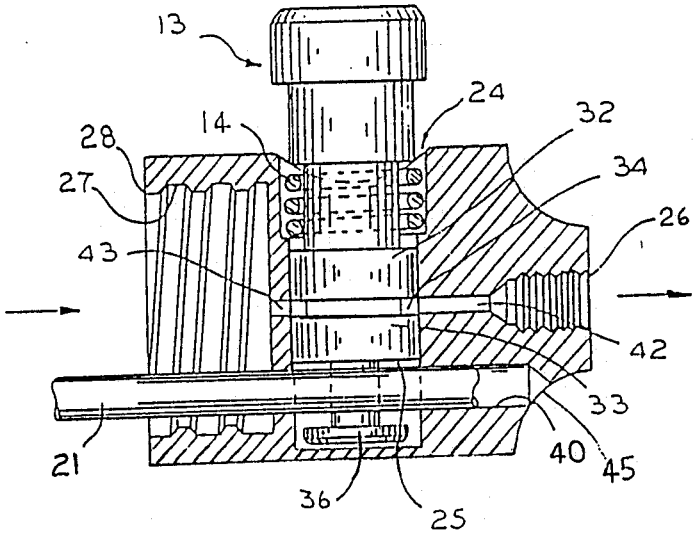
FIG. 5 of the drawings is a right side elevation, in section, of the valve body showing in particular the valve chamber.

The construction, assembly and operation of apparatus 10 is relatively straightforward and advantageously arranged. Valve chamber 25 is seen in FIGS. 4 and 5 as extending transversely within and substantially perpendicularly to valve body 12. In the preferred embodiment of the invention, valve chamber 25 is a substantially cylindrical open region which includes an inner region extending from chamber bottom 52 to chamber shoulder 41, and an outer region extending from chamber shoulder 41 to chamber opening 24. The outer region has a slightly greater diameter than the inner region, in order to accommodate the diameters of spring 14, and main stem 31 when pushbutton portion 30 is depressed, and plunger 13 is forced further into valve chamber 25. Prior to insertion of plunger 13 into valve chamber 25, helical spring 14 is slipped around and along plunger 13 until shoulder 38 is encountered. Once plunger 13 has been inserted into valve chamber 25, then vent tube 21 may be inserted, via rear opening 28, into vent passage 40 in valve body 12. Once vent tube 21 is in place, plunger 13 may not be withdrawn from valve chamber 25, due to the interference of tappet 36 and vent tube 21. Helical spring 14 will be in a compressed state, when vent tube 21 is inserted, so that spring 14 will normally tend to force plunger 13 upward. When plunger 13 is in the just-described position (not shown), lower rim 33 of plunger 13 blocks cylindrical exit passage 42 and entry passage 43 and prevents flow of fluid through apparatus 10. When plunger 13 is depressed against the force of spring 14, such as by force exerted against pushbutton portion 30, (as seen in FIGS. 4, 5) then fluid groove 34 is brought into alignment with exit passage 42 and entry passage 43 to permit free flow through apparatus 10.

Depending upon the specific configurations of the elements, a variety of fluid flow rates may be available. For example, as seen in FIG. 5, exit passage 42 and entry passage 43 are of substantially equal diameter, and relatively small compared to the diameter of back opening 28. Because of the relative narrowness of entry passage 43, in particular, when plunger 13 is depressed, entry passage 43 will tend to be opened very quickly to maximize flow, with plunger 13 being depressed only a short distance. However, if exit passage 42 and entry passage 43, and lower rim 33 were made wider relative to back opening 28, and front orifice 26, then the available flow rate could be made quite variable, in that the distance which plunger 13 could be depressed, before lower rim 33 completely unblocks entry passage 43, would be greatly increased, with the flow gradually increasing with the gradual unblocking of entry passage 43. Moreover, plunger 13 could be depressed and held at intermediate points between the released and fully depressed positions to result in intermediate flow rates depending upon the degree to which entry passage 43 is blocked.

To provide a venting function while fluid is dispensed through apparatus 10, vent passage 40 which comprises a first passage from back opening 28 to valve chamber 25, and a second passage from valve chamber 25 to vent opening 45, which is continuously open to ambient air. Accordingly, as fluid exits container 11 through exit and entry passages 42 and 43, air enters vent opening 45, and passes through vent tube 21, extension tube 22 and unidirectional check valve 23, into container 11.

A solid rod (not shown) may be alternatively utilized instead of vent tube 21, in order to provide a fluid dispenser apparatus without a vent, but with the same general structure and function. Further, valve body 12 may be provided without vent opening 45 to provide a completely sealed apparatus, if desired. If the cylindrical rod or vent tube 21 are sized to remain in vent passage 40 by forced fit, without gluing or a locking means, then disassembly and cleaning of the valve is facilitated. Should plunger 13, spring 14 and/or any of the other elements become fouled by deposits or residue, for example, apparatus 10 may not function. However, by simply pulling out the replaceable vent tube 21 (or solid rod), plunger 13 and spring 14 can be removed, and valve body 12 thoroughly cleaned.

As may be readily understood from the Figures and foregoing description, in the preferred embodiment of the invention, valve body 12, including all of its openings and passages, are configured so as to enable valve body 12 to be formed from a single solid block of material, such as plastic or cast metal, with all of the openings being formable by drilling or like machining techniques.

The foregoing description merely explains and illustrates the foregoing invention and the invention is not limited thereto, except insofar as the appended claims are so limited, as those skilled in the art who have the disclosure before them will be able to make modifications and variations therein without departing from the scope of the invention.

What is claimed is:

1. A cleaning fluid dispenser and applicator apparatus, for use with a replaceable container having therewithin a fluid, such as a cleaning fluid, for the facilitated release and delivery thereof from said container upon actuation of said apparatus, said apparatus comprising:

fluid conduit means for directing and providing a passageway for conveying said fluid away from said container, said fluid conduit means having oppositely arranged first and second ends;

flow regulation means operably associated with said first end of said fluid conduit means for the selective, manual, operator-actuated control of flow of said fluid from said container through said apparatus;

adapter means operably associated with said flow regulation means for operable attachment of said apparatus upon said container at a fluid release orifice thereof so as to define an interface between said fluid conduit means and said container;

said adapter means including sealing means for ensuring that said fluid is prevented from escaping through said interface between said fluid release orifice and said adapter means; and applicator means operably arranged upon said second end of said fluid conduit means, at a position remote from said flow regulation means, for collecting and retaining said fluid and permitting said operator to apply said fluid upon a desired surface, while enabling said operator to maintain his or her hands substantially uncontaminated by said fluid.

2. The apparatus according to claim 1 wherein said flow regulation means further comprises valve means operably positioned between said first end of said fluid conduit means and said adapter means, for controlling the flow of said fluid through said fluid conduit means by selectively interrupting said fluid flow.

3. The apparatus according to claim 2 wherein said valve means further comprises:

a substantially cylindrical valve chamber housing having a valve chamber disposed therein, said valve chamber having a substantially cylindrical inner surface and extending from an interior region of said valve chamber housing to an opening upon an outer surface region of said valve chamber housing, said valve chamber housing further having an entry passage positioned therein extending from said adapter means to an entry opening in said valve chamber, said valve chamber housing further having an exit passage positioned therein extending from an exit opening in said valve chamber, said entry and exit passages being thereby configured to enable said fluid to flow from said adapter means to said valve chamber; and from said valve chamber to said first end of said fluid conduit means, respectively;

a substantially cylindrical plunger member having a pushbutton end, and operably positioned within said valve chamber for limited longitudinal movement therein; between a first and second end positions, such that when said plunger member is in said first end position, said plunger member blocks said entry and exit passages to prevent said flow of said fluid through said flow regulation means, and when said plunger member is in said second end position, said plunger member is moved away from said entry and exit openings, enabling said flow through said flow regulation means; and a biasing member operably positioned within said valve member for continuously prompting said plunger member toward said first end position, so as to provide a valve means through which flow of said fluid is precluded, when said valve means is unactuated, but through which flow is selectively enabled when said pushbutton end of said plunger member is depressed.

4. The apparatus according to claim 3 wherein said apparatus further comprises:

venting means operably associated with said adapter means and said valve means for facilitating flow of said fluid out of said container and through said fluid dispensing apparatus by enabling entry of ambient air into said container as said fluid flows out of said container.

5. The apparatus according to claim 4 wherein said venting means further comprises:

said valve chamber housing having a first and second vent passages operably disposed therein, said first vent passage extending from said adapter means to a first vent opening in said valve chamber, said second vent passage extending from a second vent opening in said valve chamber to an outer vent opening upon an outer surface portion of said valve chamber body, a vent tube member for directing flow of ambient air into said container, a first end of said vent tube member being inserted into and through said first and second vent openings, and through said fluid orifice and into said container; and a unidirectional check valve member operably disposed on said second end of said vent tube for preventing flow of any fluid at any time from said container through said vent tube toward said valve chamber, but which allows ambient air to flow into the container to prompt flow of said fluid out of said container by increasing back pressure therein.

6. The apparatus according to claim 5 wherein said venting means further comprises:

an extension tube member which may be selectively positioned between said vent tube member and said check valve member for accommodating variably sized containers, by enabling positioning of the check valve within said container away from said fluid release orifice and adjacent to a bottom region of said container.

7. The apparatus according to claim 5 wherein said plunger member further comprises:

a tappet stem extending from an end of said plunger member, opposite said pushbutton end; and a flat substantially disk-shaped tappet member operably arranged on said tappet stem, said tappet member having a diameter greater than the width of said tappet stem, said apparatus thus having a configuration such that upon insertion of said plunger member and biasing means into said valve chamber during assembly of said apparatus, subsequent insertion of said vent tube member precludes removal of said plunger member, said tappet member being obstructed by said vent tube member, said configuration enabling the facilitated assembly, disassembly and cleaning of said apparatus.

8. The apparatus according to claim 3 wherein said apparatus further comprises:

said valve chamber housing having a first and second rod passages operably disposed therein, said first rod passage extending from said adapter means to a first rod opening in said valve chamber, said second rod passage extending from a second rod opening in said valve chamber to an outer rod opening upon an outer surface portion of said valve chamber body, an assembly rod insertable into said valve chamber body and receivable through said first and second rod passages;

said plunger member includes a tappet stem extending from an end of said plunger member, opposite said pushbutton end, and a flat substantially disk-shaped tappet member having a diameter greater than the width of said tappet stem, said apparatus thus having a configuration such that upon insertion of said plunger member and biasing means into said valve chamber during assembly of said apparatus, subsequent insertion of said assembly rod precludes removal of said plunger member, said tappet member being obstructed by said assembly rod, said configuration enabling the facilitated assembly, disassembly and cleaning of said apparatus.

9. The apparatus according to claim 3 wherein said valve means further comprises:

said plunger member having contours formed upon an outer surface thereof which cooperate with said inner surface of said valve chamber so as to completely block said entry and exit openings, and thereby prevent flow of said fluid, when said plunger member is in said first end position, but which gradually unblock said entry and exit openings, as said pushbutton end of said plunger member is gradually depressed, so as to gradually increase flow of said fluid, until said plunger member is in said second end position, said entry and exit openings are completely unblocked and a maximum rate of flow of said fluid is permitted.

10. The apparatus according to claim 3 wherein said biasing means comprises a compressed helical spring.

11. The apparatus according to claim 1 wherein said fluid conduit means comprises an elongated rigid hollow tubing member.

12. The apparatus according to claim 1 wherein said adapter means further comprises:

a hollow cylindrical housing member having a first end, operably associated with said flow regulation means for directing the flow of said fluid towards said fluid conduit means; and said sealing means includes a second substantially open end of said hollow cylindrical housing member, having a screwthreaded inner annular surface for threaded receipt by said adapter means of said container holding said fluid.

13. The apparatus according to claim 1 wherein said applicator means includes:

a substantially planar applicator plate operably arranged upon said second end of said fluid conduit means, and having an aperture disposed centrally thereof for enabling passage of said fluid out of said fluid conduit means; and fluid retaining and scrubbing means operably arranged upon said applicator plate for collecting said fluid and retarding evaporation of said fluid for application upon a desired surface.

14. The apparatus according to claim 13 wherein said fluid retaining and scrubbing means comprises a densely-packed porous material.

15. The apparatus according to claim 14 wherein said densely-packed porous material comprises a foam-rubber sponge.

16. The apparatus according to claim 13 wherein said applicator plate is arranged at a substantially oblique angle relative to said fluid conduit means.

17. The apparatus according to claim 13 wherein said fluid retaining and scrubbing means comprises:

an applicator clip configured for removable placement and retention upon said applicator plate; and a densely packed porous sponge affixed to said applicator clip, said combined applicator clip and said sponge being selectively replaceable when said sponge becomes soiled, worn or the like, for convenience and increased useful life of said fluid dispenser apparatus.

18. The apparatus according to claim 1 wherein said flow regulating means and said adapter means are both operably disposed within a substantially cylindrical housing.

19. The apparatus according to claim 1 wherein said apparatus is used in combination with a container having therewithin a substantially liquid freon solvent compound, for cleaning printing surfaces of electronic printing apparatuses, among other surfaces.

20. A cleaning fluid dispenser and applicator apparatus, for use with a replaceable container having therewithin a fluid, such as a cleaning fluid, for the facilitated release and delivery thereof from said container upon actuation of said apparatus, said apparatus comprising:

fluid conduit means for directing and providing a passageway for conveying said fluid away from said container, said fluid conduit means having oppositely arranged first and second ends;

flow regulation means operably associated with said first end of said fluid conduit means for the selective, operator-actuated control of flow of said fluid from said container through said apparatus;

adapter means operably associated with said flow regulation means for operable attachment of said fluid dispensing apparatus upon said container at a fluid release orifice thereof so as to define an interface between said fluid conduit means and said container;

said adapter means including sealing means for ensuring that said fluid is prevented from escaping through said interface between said fluid release orifice and said adapter means;

said flow regulation means including valve means operably positioned between said first end of said fluid conduit means and said adapter means, for controlling the flow of said fluid through said fluid conduit means by selectively interrupting said fluid flow, said valve means further including a substantially cylindrical valve chamber housing having a valve chamber disposed therein, said valve chamber having a substantially cylindrical inner surface and extending from an interior region of said valve chamber housing to an opening upon an outer surface region of said valve chamber housing, said valve chamber housing further having an entry passage positioned therein extending from said adapter means to an entry opening in said valve chamber, said valve chamber housing further having an exit passage positioned therein extending from an exit opening in said valve chamber, said entry and exit passages transporting said fluid from said adapter means to said valve chamber; and from said valve chamber to said first end of said fluid conduit means, respectively, a substantially cylindrical plunger member having a pushbutton end, and operably positioned within said valve chamber for limited longitudinal movement therein, between a first and second end positions, such that when said plunger member is in said first end position, said plunger member blocks said entry and exit passages to prevent flow of said fluid through said flow regulation means, and when said plunger member is in said second end position, said plunger member is moved away from said entry and exit openings, enabling flow of said fluid through said flow regulation means, said plunger member further including a tappet stem extending from an end of said plunger member, opposite said pushbutton end, and a flat substantially disk-shaped tappet member operably arranged on said tappet stem, said tappet member having a diameter greater than the width of said tappet stem, said valve means further having a biasing member operably positioned within said valve chamber for continuously prompting said plunger member toward said first end position, so as to provide a valve means through which flow of said fluid is precluded, when said valve means is unactuated, but through which flow is selectively enabled when said pushbutton end of said plunger member is depressed;

applicator means operably arranged upon said second end of said fluid conduit means for collecting and retaining said fluid and permitting said operator to apply said fluid upon a desired surface; and venting means operably associated with said adapter means and said valve means for facilitating flow of said fluid out of said container and through said fluid dispensing apparatus by enabling entry of ambient air into said container as said fluid flows out of said container, said venting means including first and second vent passages operably disposed in said valve chamber housing, said first vent passage extending from said adapter means to a first vent opening in said valve chamber, said second vent passage extending from a second vent opening in said valve chamber to an outer vent opening upon an outer surface portion of said valve chamber body, a vent tube member for directing flow of ambient air into said container, a first end of said vent tube member being inserted into and through said first and second vent openings, and through said fluid orifice and into said container; and a unidirectional check valve member operably disposed on said second end of said vent tube for preventing flow of any fluid at any time from said container through said vent tube toward said valve chamber, but which allows ambient air to flow into the container to prompt flow of said fluid out of said container by increasing back pressure therein, said apparatus thus having a configuration such that upon insertion of said plunger member and biasing means into said valve chamber during assembly of said apparatus, subsequent insertion of said vent tube member precludes removal of said plunger member said tappet member being obstructed by said vent tube member, said configuration enabling the facilitated assembly, disassembly and cleaning of said apparatus.

21. The apparatus according to claim 20 wherein said valve means further comprises:

said plunger member having contours formed upon an outer surface thereof which cooperate with said inner surface of said valve chamber so as to completely block said entry and exit openings, and thereby prevent flow of said fluid, when said plunger member is in said first end position, but which gradually unblock said entry and exit openings, as said pushbutton end of said plunger member is gradually depressed, so as to gradually increase flow of such fluid, until said plunger member is in said second end position, said entry and exit openings are completely unblocked and a maximum rate of flow of said fluid is permitted.

22. The apparatus according to claim 20 wherein said biasing means comprises a compressed helical spring.

23. The apparatus according to claim 20 wherein sid fluid conduit means comprises an elongated rigid hollow tubing member.

24. The apparatus according to claim 20 wherein said adapter means further comprises:

a hollow cylindrical housing member having a first end, operably associated with said flow regulation means for directing the flow of said fluid towards said fluid conduit means; and said sealing means includes a second substantailly open end of said hollow cylindrical housing member, having a screwthreaded inner annular surface for threaded receipt by said adapter means of said container holding said fluid.

25. The apparatus according to claim 20 wherein said applicator means includes:

a substantially planar applicator plate operably arranged upon said second end of said fluid conduit means, and having an aperture disposed centrally thereof for enabling passage of said fluid out of said fluid conduit means; and fluid retaining and scrubbing means operably arranged upon said applicator plate for collecting said fluid and retarding evaporation of said fluid for application upon a

26. The apparatus according to claim 25 wherein said fluid retaining and scrubbing means comprises a densely-packed porous material.

27. The apparatus according to claim 26 wherein said densely-packed porous material comprises a foam-rubber sponge.

28. The apparatus according to claim 25 wherein said applicator plate is arranged at a substantially oblique angle relative to said fluid conduit means.

29. The apparatus according to claim 25 wherein said fluid retaining and scrubbing means comprises:

an applicator clip configured for removable placement and retention upon said applicator plate; and a densely packed porous sponge affixed to said applicator chip, said combined applicator clip and said sponge being selectively replaceable when said sponge becomes soiled, worn or the like, for convenience and increased useful life of said apparatus.

30. The apparatus according to claim 20 wherein said flow regulating means and said adapter means are both operably disposed within a substantially cylindrical housing.

31. The apparatus according to claim 20 wherein said apparatus is used in combination with a container having therewithin a substantially liquid freon solvent compound, for cleaning printing surface of electronic printing apparatuses, among other surfaces.

* * * * *

UNITED STATES PATENT AND TRADEMARK OFFICE

CERTIFICATE OF CORRECTION

PATENT NO. : 4,966,481

DATED : October 30, 1990

INVENTOR(S) : Robert Satten; Helmut Held

It is certified that error appears in the above-identified patent and that said Letters Patent is hereby corrected as shown below:

| | |
|---|---|
| ABSTRACT - Line 2: | Delete "apparata" and insert instead --apparatuses--. |
| Col. 1, Line 27: | Delete "user,s" and insert instead --user's--. |
| Col. 5, Line 11: | Delete "ordinarilY" and insert instead --ordinarily--. |
| Col. 13, Line 18: | Delete "screwthreaded" and insert instead --screw-threaded--. |
| Col. 14, Line 2: | Delete "upon a" and insert instead --upon a desired surface--. |
| Col. 14, Line 17: | Delete "chip" and insert instead --clip--. |
| Col. 14, Line 28: | Delete "surface" and insert instead -surfaces--. |

Signed and Sealed this

Twenty-third Day of June, 1992

*Attest:*

DOUGLAS B. COMER

*Attesting Officer*

*Acting Commissioner of Patents and Trademarks*